US009580844B2

(12) United States Patent
Debaes et al.

(10) Patent No.: US 9,580,844 B2
(45) Date of Patent: Feb. 28, 2017

(54) METHOD FOR WEAVING PILE FABRICS AND FOR CONFIGURING A WEAVING LOOM THEREFOR

(71) Applicant: NV MICHEL VAN DE WIELE, Kortrijk/Marke (BE)

(72) Inventors: Johny Debaes; Ludo Smissaert, Assebroek (BE)

(73) Assignee: NV MICHEL VAN DE WIELE, Kortriji/Marke (BE)

( * ) Notice: Subject to any disclaimer, the term of this patent is extended or adjusted under 35 U.S.C. 154(b) by 14 days.

(21) Appl. No.: 14/760,201

(22) PCT Filed: Jan. 8, 2014

(86) PCT No.: PCT/IB2014/058119
§ 371 (c)(1),
(2) Date: Jul. 9, 2015

(87) PCT Pub. No.: WO2014/108833
PCT Pub. Date: Jul. 17, 2014

(65) Prior Publication Data

US 2015/0354107 A1 Dec. 10, 2015

(30) Foreign Application Priority Data

Jan. 10, 2013 (BE) ..... 2013/0017

(51) Int. Cl.
*D03D 27/10* (2006.01)
*D03D 39/16* (2006.01)

(52) U.S. Cl.
CPC ..... *D03D 27/10* (2013.01); *D03D 39/16* (2013.01)

(58) Field of Classification Search
CPC ..... D03D 27/10; D03D 39/16
See application file for complete search history.

(56) References Cited

U.S. PATENT DOCUMENTS 1,270,230 A * 6/1918 Sohn ..... D03D 27/10 139/397
3,519,032 A * 7/1970 Sabbe ..... D03D 27/10 139/398
3,612,110 A * 10/1971 Wildi ..... D03D 11/00 139/383 R (Continued)

FOREIGN PATENT DOCUMENTS

BE 1008129 A4 1/1996
BE 1013582 A7 4/2002

OTHER PUBLICATIONS

International Search Report dated Sep. 4, 2014.

*Primary Examiner* — Bobby Muromoto, Jr.
(74) *Attorney, Agent, or Firm* — Symbus Law Group, LLC; Clifford D. Hyra

(57) ABSTRACT

A weaving method for the double-face weaving of pile fabrics wherein at least five different pile warp threads (12-19), (20-27) with a yarn number of between 6 and 10 Nm final and at least two tension warp threads (8),(9); (10,11) are provided for each warp thread system (100) and for each fabric (28), (29), wherein the weft threads (1,2), (2,3) of each fabric are divided over at least three levels, while the ground weave repeat runs over at least eight insertion cycles (I-VIII), wherein between 200 and 1000 warp thread systems per meter are provided, and at least 16 pile rows per cm are formed in the warp direction.

27 Claims, 2 Drawing Sheets

(56) References Cited

U.S. PATENT DOCUMENTS

| | | | | | |
|---|---|---|---|---|---|
| 4,756,340 | A * | 7/1988 | Janssen | D03D 27/10 | 139/397 |
| 5,431,786 | A * | 7/1995 | Rasch | D21H 27/02 | 139/383 R |
| 5,465,761 | A * | 11/1995 | Gheysen | D03D 27/10 | 139/21 |
| 5,771,943 | A * | 6/1998 | Carlson | D03D 27/02 | 139/39 |
| 6,012,083 | A * | 1/2000 | Savitzky | G06F 17/21 | 707/999.01 |
| 6,273,148 | B1 * | 8/2001 | Debaes | D03D 27/10 | 139/116.5 |
| 6,336,475 | B2 * | 1/2002 | Dewispelaere | 139/391 | |
| 6,923,219 | B2 * | 8/2005 | Shteiyer | D03D 27/10 | 139/394 |
| 7,089,967 | B2 * | 8/2006 | Debaes | D03D 27/06 | 139/102 |
| 7,287,552 | B2 * | 10/2007 | Debaes | D03D 27/10 | 139/191 |
| 7,395,839 | B2 * | 7/2008 | Debaes | D03D 39/16 | 139/116.5 |
| 7,520,303 | B2 * | 4/2009 | Mertens | D03D 27/10 | 139/102 |
| 7,644,737 | B2 * | 1/2010 | Mueller | D03D 35/00 | 139/11 |
| 7,658,209 | B2 * | 2/2010 | Debaes | D03C 1/00 | 139/21 |
| 2001/0010236 | A1 * | 8/2001 | Dewispelaere | D03D 27/10 | 139/391 |
| 2007/0006932 | A1 | 1/2007 | Mertens et al. | | |
| 2015/0354107 | A1 * | 12/2015 | Debaes | D03D 39/16 | 139/21 |

* cited by examiner

METHOD FOR WEAVING PILE FABRICS AND FOR CONFIGURING A WEAVING LOOM THEREFOR

This application claims the benefit of Belgian patent application No. BE2013/0017, filed Jan. 10, 2013, which is hereby incorporated by reference in its entirety.

FIELD OF THE INVENTION

The present invention relates to a weaving method, wherein, on a double-face weaving loom, in successive weft insertion cycles, in each case one or more weft threads are inserted at respective insertion levels between the warp threads of a number of warp thread systems, while the warp threads are positioned such that two ground fabrics can be woven one above the other from respective weft threads which are bound in openings between binding warp threads and tension warp threads, wherein a number of different pile warp threads are provided for each warp thread system, at least one of which is alternately interlaced with the upper and the lower ground fabric in order to form pile, and wherein the pile-forming pile warp threads between both ground fabrics are cut, so that two pile fabrics are produced.

The present invention relates in particular to such a weaving method which involves a particular method for configuring the weaving loom.

BACKGROUND

The term 'different pile warp threads' generally means that the pile warp threads have one or more mutually different appearance-determining properties. These properties are for example thickness, shine, hairiness or colour of the pile yarn or a combination of two or more of these properties. However, in the most preferred applications, these will be pile warp threads which differ at least by their colour.

The number of different pile warp threads per warp thread system determines how much variation is possible with regard to the pile. In order to produce pile fabrics, for example, in which the pile has five different colours, five pile warp threads having mutually different colours have to be provided for each warp thread system. In order to then produce a predetermined five-colour pattern in the pile, the pile warp thread of the desired colour is allowed to form pile in each warp thread system, at each pile point determined by the pattern, while the other pile warp threads of the same pile warp thread system are invisibly bound in the ground fabric. To this end, the different pile warp threads in each weft insertion cycle have to be positioned correctly. This is usually achieved using a jacquard machine. In order to increase the variation in the pile, the number of pile warp threads in each warp thread system has to be increased.

However, the number of warp threads which can be provided per meter on a weaving loom is limited by the physical properties of the machine and a number of technical limitations associated with weaving. Thus, with certain weaving looms and for a well-defined selection of yarns (indicated by the yarn number), it is practically impossible to weave at more than 1000 warp thread systems per meter (in the weft direction), while each warp thread system contains eight pile warp threads (8 colour frames). Above a certain upper limit, it is therefore no longer possible to increase the number of pile warp threads per warp thread system for a certain weaving loom, as a result of which there is also an upper limit for the possible pile variations of the pile fabrics which are woven therewith, when retaining the same number of warp thread systems per meter. This is also connected to the means which are available in the weaving loom to produce these pile fabrics, such as the weaving reeds with their associated reed dents, and the heddles which control ground warp threads and pile warp threads and a corresponding number of which should therefore also be present within the available space.

Thus, with the following yarns, it is for example possible to weave at 1000 warp thread systems per meter and 8 different pile warp threads per warp thread system (reed 1000, 8 colours):

- Pile warp yarns with a density, given in 'meter per gram of yarn' or metric number (Nm), in the order of magnitude of 24/3 Nm, i.e. 8 Nm final,
- associated weft threads for the ground fabric with yarn numbers 10/1 Nm or 14/1 Nm, and
- associated external weft threads around which pile forming takes place, with a yarn number in the order of magnitude of 20/3 Nm or approximately 6 Nm final.

The expression Nm final is understood to mean the number of meters per gram of an optionally compound yarn: 24/3 Nm means that the yarn is composed of 3 yarn components, each of which has a yarn number of 24 meters per gram. The compound yarn number is then 8 Nm or 8 meters per gram.

In this case, it is feasible to provide up to approximately 12 pile rows per cm in the warp direction in the pile fabric.

In order to be able to increase the pile variation, the number of warp thread systems per meter may be decreased so that more pile warp threads per warp thread system can be provided. However, this results in larger intermediate spaces between the successive pile rows in the weft direction, which reduces the number of pile points per cm in the weft direction and thus also the pile density (number of pile points per $m^2$). Furthermore, it also results in a less uniform pile distribution.

SUMMARY

It is a first object of the present invention to solve the above-described problem by providing a weaving method by means of which, on certain weaving looms, it is possible to weave pile fabrics with more pile variation, while still retaining a uniform pile distribution and a virtually identical pile density.

This object is achieved by providing a weaving method having the features indicated in the first paragraph of this description, wherein, according to the present invention, between 200 and 1000 warp thread systems per meter are provided on the double-face weaving loom, wherein, in each warp thread system, at least five different pile warp threads with a yarn number between 6 and 10 Nm final and at least two tension warp threads are provided per ground fabric, and the tension warp threads are positioned in such a way that they divide the weft threads of each pile fabric over at least three different levels, while a ground weave repeat is used which runs over at least eight weft insertion cycles, and wherein at least 16 pile rows per cm in the warp direction are formed.

By weaving according to this weaving method, the weft thread density (the number of weft threads per meter) in the pile fabrics is increased to such a degree that a sufficiently high pile density is achieved, even with a lower number of warp thread systems per meter. As a result of the high weft thread density, the weft threads over which pile is formed are also closer together, making it possible to increase the number of pile rows per cm in the warp direction. By now providing at least 16 pile rows per cm (1600 per meter) in the warp direction, between 200 and 1000 warp thread systems per meter in the weft direction, an imbalance is produced between the theoretical pile density in the warp direction (at least 1600 pile rows per meter with two pile legs per pile tuft, i.e. at least 3200 pile legs per meter) and the theoretical pile density in the weft direction (between 200 and 1000 pile legs per meter). The ratio between both theoretical densities (in the numerator the theoretical number of pile legs per meter in the warp direction, and in the denominator the theoretical number of pile legs per meter in the weft direction) may be seen as a measure of this imbalance, referred to below as the imbalance factor. It may be inferred, from the given limits, that this imbalance factor according to the invention is at least 3.2 (3200/1000).

If pile warp threads with a yarn number of between 6 and 10 Nm final are used with such an imbalance (imbalance factor≥3.2), it is found, in practice, that the pile legs which are very close to each other in the warp direction influence each other's position in the pile fabric in such a way that the pile legs assume a position which is shifted in the weft direction, thus also increasing the number of pile points in the weft direction, as a result of which it is still possible to achieve a uniform pile distribution. In other words, the practical pile density in the weft direction will be greater than the theoretical pile density in the weft direction, due to the abovementioned imbalance at said yarn thicknesses (between 6 and 10 Nm final).

By applying the weaving method according to the present invention, it is thus possible to weave using a smaller number of warp thread systems per meter, as a result of which it is possible to increase the number of pile warp threads per warp thread system on a certain weaving loom, thus making it possible to produce greater pile variation while hardly resulting in any drawbacks with regard to the pile density and the pile distribution.

The weft thread density could be increased to such a degree through a combination of measures. A first measure consists in dividing the weft threads of each ground fabric over three levels by means of two tension warp threads, as a result of which these weft threads can be placed one above the other and/or very close next to each other in the fabric. On the other hand, a long ground weave repeat is simultaneously applied as a second measure in each ground fabric for the ground warp threads of the ground fabric, and runs for at least eight weft insertion cycles. The expression 'a ground weave repeat which runs for at least eight weft insertion cycles' may, if necessary, be explained as follows: the ground warp threads (binding warp and tension warp threads), together with the weft threads which are connected thereto, form the ground fabric and in this case have a well-defined path with respect to the weft threads which are inserted in the successive weft insertion cycles. In this case, the positions of all ground warp threads with respect to the weft threads occur in a series of a continually repeating series of fixed number of successive weft insertion cycles. If this fixed number of weft insertion cycles is eight or more, a ground weave repeat which runs for at least eight weft insertion cycles is obtained for the ground warp threads.

By using such a long ground weave repeat for the binding warp threads, few crossings of binding warp threads occur between the successive weft threads of the ground fabric. The fewer of such crossings, the better and closer together the weft threads can be positioned next to and above each other in the ground fabric, resulting in a respective increase in the weft thread density. This second measure and the first measure enhance each other.

Providing, in this weaving method, at least five different pile warp threads per warp thread system per ground fabric, also results in pile fabrics which have a large degree of variation in the pile. Preferably, this variation is a variation in colour.

With this method, a repeat for at least eight weft insertion cycles is used for the ground weave structures. However, with a preferred method, the repeat runs for at least twelve weft insertion cycles, more preferably for at least sixteen weft insertion cycles. In a very preferred method, a repeat for the ground weave structure of at least twenty-four weft insertion cycles is used. Most preferably, this repeat runs for at least thirty-two weft insertion cycles. In a particular application, a repeat is used which runs along the entire length of the fabric in the warp direction.

When using this weaving method, the weft threads bound in each ground fabric are preferably divided over at least two different levels by at least one tension warp thread per warp thread system, while other weft threads run on the back of the ground fabrics without being bound in said openings between binding warp threads.

As a result of binding in the weft threads to be bound in the ground fabric at different levels and the fact that, as has already been mentioned, they are not hampered by many crossings of binding warp threads, and by not binding in other weft threads and allowing them to run on the back of the ground fabrics, it is possible to achieve a very high weft thread density.

This effect is further increased by separating the weft threads running on the back of the ground fabrics from the other weft threads by a tension warp thread.

In a preferred method, the warp thread systems comprise secondary binding warp threads which are positioned in such a way that each pile fabric comprises a number of secondary binding warp threads which are alternately interlaced with the ground fabric, and run over at least one weft thread running on the back thereof in order to fix these weft threads with respect to the ground fabric.

With fabrics where weft threads run along the back, it is known to use the pile warp threads to support the lower weft insertion means, but this may damage these pile warp threads and adversely affect the quality of the fabric. It is also known to provide this support by means of auxiliary threads which do not form part of the fabric and which are subsequently lost, but this has the obvious drawback that it entails additional costs. If the weft threads running on the back are fixed by secondary binding warp threads, these secondary binding warp threads can be used to support the lower weft insertion means, and the abovementioned drawbacks do not occur. For reasons of uniformity, it is then possible to use secondary binding warp threads for the upper fabric as well.

By additionally also interlacing the pile-forming pile warp threads in each case with at least one weft thread running on the back, the weft thread density, and thus also the number of pile rows in the warp direction, can be increased further.

Preferably, the non-pile-forming pile warp threads are bound in the ground fabrics in an extended state. In this case, they are preferably bound in an extended state between the weft threads of two different levels. Alternatively, they may also execute a limited movement around one or more weft threads at certain positions, preferably weft threads which are situated on the pile side of the fabric, in order to fix these pile warp threads locally.

According to a particularly preferred method, the weft threads are inserted between the warp threads provided on the weaving loom, wherein N warp thread systems per meter are provided, each with K different pile warp threads per warp thread system, wherein K≥10 and N is an integer between 200 and 1000, preferably between 250 and 600, and most preferably equals 500.

This means that all pile warp threads of a warp thread system differ from one another. Thus, for example, each warp thread system has 16 pile warp threads and these 16 pile warp threads differ from each other in each warp thread system by one or more appearance-defining properties, such as for example their colour. When comparing the warp thread systems to each other, the constituent K pile warp threads are preferably identical.

By providing fewer warp thread systems per meter, the theoretical number of pile points per cm in the weft direction is reduced. In order to compensate for this, preferably at least 16 pile rows per cm are formed in the warp direction. More preferably, even 17 or 18 pile rows per cm are formed. With a weave structure where one pile row is formed for every three inserted weft threads in the warp direction, this means a weft thread density of 54 weft threads/cm (54 picks/cm). If, for example, 500 warp thread systems are provided per meter in the weft direction and 18 pile rows per cm are provided in the warp direction, this results in an imbalance factor of 7.2 (3600 pile legs per meter/500 pile legs per meter).

This can be achieved using the following yarns which are usually used to weave at 1000 warp thread systems per meter and 8 different pile warp threads per warp thread system (reed 1000, 8 colours):

- Pile warp yarns having a density, denoted by 'meter per gram of yarn' or metric number (Nm), of between 6 and 10 Nm final, preferably 8 Nm final, for example with an indication 24/3 Nm or 16/2 Nm
- associated weft threads for the ground fabric with final yarn numbers between 6 and 16 Nm final, preferably 10 or 14 Nm final, such as for example yarns with a yarn number indication 10/1 Nm or 14/1 Nm, and
- associated external weft threads around which pile forming takes place, with final yarn numbers between 4 and 8 Nm final, preferably between 5 and 7 Nm final, such as for example yarns with a yarn number indication 20/3 or 12/2 Nm.

The quality of the fabrics and the efficiency of the weaving process is particularly good if the warp threads extend through the openings of a weaving reed, with the warp threads of each warp thread system being divided over two adjacent openings of the weaving reed, so that they are divided into two groups which are separated from one another by an intermediate reed dent.

Preferably, the weaving loom is configured in such a manner that a first group of warp threads of a first warp thread system and a second group of warp threads of a second warp thread system extend through each reed opening.

It is furthermore also particularly advantageous for the quality of the fabric and the efficiency of the weaving process if the first and the second group are situated in a left-hand part and a right-hand part of the reed opening, respectively, while at least one tension warp thread of the first group extends in the reed opening along the right-hand side of the pile warp threads of this group, and at least one tension warp thread of the second group extends in the reed opening along the left-hand side of the pile warp threads of this group.

The tension warp threads detain the pile warp threads of each group, so that they do not move excessively far sideways (in the weft direction) in the reed opening and are kept in their respective part of the reed opening. This prevents the pile warp threads of a warp thread system from forming pile tufts in positions which deviate too much from the intended line for the warp thread system.

The warp threads preferably extend through the openings of the weaving reed in such a manner that N warp thread systems are in each case distributed over N openings or N+1 openings of the weaving reed. In this case, N is the number of warp thread systems per meter which is provided on the weaving loom.

In its most preferred form, the weaving method is used on a triple rapier weaving loom, and in each case three weft threads are inserted at respective insertion levels between the warp threads in the successive weft insertion cycles.

This results in the advantage that the non-pile-forming pile warp threads in the upper and the lower ground fabric can be bound in an extended state without having to change their position with respect to the three weft insertion levels.

Thus, using three rapiers, it is possible to insert in each case an upper, a middle and a lower weft thread at three different insertion levels, for example during the successive insertion cycles, and in this case position the warp threads in each insertion cycle with respect to these insertion levels such that the following takes place alternately:

(i) the upper and the middle weft thread are bound in the upper fabric while the lower weft thread is bound in the lower fabric, and
(ii) the upper weft thread is bound in the upper fabric while the middle and the lower weft thread are bound in the lower fabric.

In the successive insertion cycles the following then also preferably takes place alternately:

(i) the upper weft thread is inserted in the upper fabric on the back of the ground fabric and is not bound in by the binding warp threads, and
(ii) the lower weft thread is inserted in the lower fabric on the back of the ground fabric and not bound in by the binding warp threads.

The non-pile-forming pile warp threads which are to be bound in the upper fabric can then remain positioned at a level between the upper and the middle insertion level, while the non-pile-forming pile warp threads which are to be bound in the lower fabric can remain positioned at a level between the middle and the lower insertion level. Thus, these pile warp threads do not have to be moved during the weaving process.

In particular with weaving methods for weaving fabrics with a lot of pile variation, the preparation or configuration of the weaving loom is very time consuming. It usually requires one or more of the following operations:

1) Providing the required yarns:
   - a spool has to be provided for all pile warp threads on a creel which is situated behind the machine;
   - the ground warp threads have to be beamed on one or more beams and to be inserted in the ground beam stand of the machine;
   - the weft threads have to be provided in the weft bobbin stand;
   - the proper spare yarns have to be kept at the ready.
2) The machine has to be fitted with the appropriate means:
   - a weaving reed with a suitable number of openings is to be provided;
   - the jacquard which positions the pile warp threads has to be provided with a harness with heddles which are suitably dimensioned for the dimensions of the heddle eyelet and the thread shape of the connecting part, and associated retracting springs;

the heddle frames which position the ground warp threads have to be provided with heddles which are suitable in terms of dimension of the heddle eyelet and the thread shape of the connecting part;

for each warp thread a drop wire is to be provided which rests on the yarn and generates a signal in case of loss of tension or rupture so that suitable measures can be taken;

the suitable weft insertion means and associated accessories, such as clamping springs, have to be provided in order to be able to insert the desired weft threads.

3) All warp threads have to be inserted in the machine, one by one and in the correct order according to the weft direction, along the guiding parts, such as lattices and rollers, and through the heddle eyelets and through the correct reed opening;

4) All warp threads inserted via the weaving reed then have to be collected and connected to a controlled drawing roller, so that they can move forward simultaneously at a speed which matches the desired movement per weft insertion cycle, so that the correct weft thread density can be ensured.

5) Control of the machine and jacquard has to be programmed, so that when a certain colour effect is chosen at a certain point in the pile fabric, the associated pile warp thread is moved correctly so as to form pile, and so that the other pile warp threads which are non-pile-forming at that point also execute an associated correct non-pile-forming movement; at the same time, the heddle frames also have to execute the correct movement.

In this case, it should be noted that an increase in the number of possible colours at a certain point in a pile fabric means that more non-pile-forming pile warp threads have to be controlled in a suitable manner to achieve a certain desired colour effect.

This also means that a larger amount of work is required to provide all these pile warp threads together with the associated means and to insert the pile warp threads into these means.

In a preferred weaving method according to the present invention, the double-face weaving loom is configured to weave two pile fabrics according to a weaving method wherein N warp thread systems per meter are provided, each with K different pile warp threads, and this configuration is achieved by modifying the configuration of a double-face weaving loom which is configured to weave using (s×N) warp thread systems per meter which each contain K/s different pile warp threads, this modification meaning that the (s×N) warp thread systems are divided into N series of s successive warp thread systems, and that, within each series, the K/s pile warp threads of (s−1) of these warp thread systems are replaced by K/s other pile warp threads, so that each series of s warp thread systems together contains K different pile warp threads and the warp threads of each series together form one combined warp thread system, wherein K, K/s, N and s are integers, with s≥2, and wherein N is an integer between 200 and 1000.

This makes it easier and quicker to configure the weaving loom. A number of possible modifications of the configuration of a weaving loom according to the present method are illustrated by means of the values in the table below. For each row in the table, the values in the two left-most columns headed by sN and K/s relate to the number of warp thread systems per meter (sN) and the number of different pile warp threads per warp thread system (K/s), respectively, of the configuration to be modified (the starting situation), and the values in the two right-most columns headed by N and K relate to the number of warp thread systems per meter (N) and the number of different pile warp threads per warp thread system (K), respectively, of the modified weaving loom (the end situation: the result of the modification). The value s relating to each row can be taken from the middle column.

In this case, each row of the table below relates to a different modification of the configuration of a weaving loom, wherein the starting situation and the end situation are in each case indicated by the number of warp thread systems per meter (sN), (N) and the number of different pile warp threads per warp thread system (K/s), (K). The situations of different rows cannot be compared to one another.

In the situation of each row in the table, the yarn number of the pile warp threads and the number of pile rows per meter in the warp direction is determined within the above-defined limits according to the present invention, so that the machine in the end situation is suitable to weave according to the weaving method from the present invention. In the starting situation, the weaving loom is not suitable to weave according to this weaving method.

Obviously numerous other modifications are also possible, wherein all values of the associated parameters differ to a greater or lesser extent from those in the table, or wherein only the values of one or two of the three parameters N, K and s differ to a greater or lesser extent. It will be clear that the table cannot be regarded as an exhaustive list.

| before modification | | | after modification | |
|---|---|---|---|---|
| aN | K/a | a | N | K |
| 1200 | 8 | 2 | 600 | 16 |
| 1200 | 6 | 2 | 600 | 12 |
| 1200 | 4 | 3 | 400 | 12 |
| 1200 | 4 | 4 | 300 | 16 |
| 1200 | 3 | 4 | 300 | 12 |
| 1000 | 10 | 2 | 500 | 20 |
| 1000 | 8 | 2 | 500 | 16 |
| 1000 | 6 | 2 | 500 | 12 |
| 1000 | 4 | 4 | 250 | 16 |
| 700 | 12 | 2 | 350 | 24 |
| 700 | 10 | 2 | 350 | 20 |
| 700 | 8 | 2 | 350 | 16 |
| 700 | 6 | 2 | 350 | 12 |
| 500 | 16 | 2 | 250 | 32 |
| 500 | 14 | 2 | 250 | 28 |
| 500 | 12 | 2 | 250 | 24 |
| 500 | 10 | 2 | 250 | 20 |
| 500 | 8 | 2 | 250 | 16 |
| 500 | 6 | 2 | 250 | 12 |

With this weaving method, s preferably equals 2.

With another preferred weaving method, N preferably equals 500, while K equals 16 and s equals 2.

The weaving loom is preferably provided with positioning means which cooperate with a control device to position the warp threads in accordance with a predetermined control program, while the modification of the configuration of the weaving loom also means that the control program of the weaving loom is modified in such a way that the warp threads for each series of s warp thread systems are controlled as the warp threads of one combined warp thread system during weaving.

The warp threads of the weaving loom which is configured in this way preferably extend through the reed openings of a weaving reed, while the number of combined warp thread systems per meter (N) of the configured weaving loom equals the number of reed openings, or is a multiple of this number.

In this case, the warp threads of each combined warp thread system preferably run through the same reed opening of a weaving reed together.

In a preferred configuration of the weaving loom, the warp threads of each combined warp thread system can then be divided over two adjacent openings of the weaving reed, so that they are divided into two groups which are separated from one another by an intermediate reed dent.

A second object of the present invention is to solve the abovementioned problems associated with configuring a double-face weaving loom by providing a method for configuring a double-face weaving loom which can be carried out in a simpler and quicker way, and by means of which the double-face weaving loom can be configured to weave two pile fabrics according to a weaving method, wherein, in successive weft insertion cycles, in each case one or more weft threads are inserted between the warp threads provided on the weaving loom, wherein N warp thread systems per meter are provided, each with K different pile warp threads, wherein the warp threads are positioned in such a manner that two ground fabrics are woven, one above the other, from respective weft threads and binding warp threads, wherein at least one pile warp thread per warp thread system is alternately interlaced with the upper and the lower ground fabric to form pile, and wherein the pile-forming pile warp threads between both ground fabrics are cut.

This second object is achieved in a very efficient manner by modifying the configuration of a double-face weaving loom which is intended for weaving with (s×N) warp thread systems per meter which each contain K/s different pile warp threads, by dividing the (s×N) warp thread systems into N series of s successive warp thread systems and by replacing, within each series, the K/s pile warp threads of (s−1) of these warp thread systems by K/s other pile warp threads, so that each series of s warp thread systems together contains K different pile warp threads, and the warp threads of each series together form one combined warp thread system, wherein K, K/s, N and s are integers and wherein s≥2.

Here, reference is made to the table provided above in this patent application which contains a number of examples of a number of possible modifications of the configuration of a weaving loom, and to the description in connection with this table.

In a preferred method for configuring a weaving loom according to the invention, s=2.

Preferably, a number of warp threads per meter are provided which is between 200 and 1000, preferably between 250 and 600, most preferably equals 500.

A particularly preferred method is arrived at if N=500, K=16 and s=2. In this case, the configuration of a weaving loom which is intended for weaving with 1000 warp thread systems per meter, wherein eight different pile warp threads are provided for each warp thread system, is modified, this modification consisting in dividing the warp thread systems into series of two warp thread systems, and replacing, within each series of two, the eight pile warp threads of one of both warp thread systems by eight other ones, so that each series together contains sixteen different (preferably differently coloured) pile warp threads, and the warp threads of each series together form one combined warp thread system.

The weaving loom is preferably provided with positioning means which cooperate with a control device (preferably a jacquard machine) to position the warp threads in accordance with a predetermined control program, and configuring the weaving loom therefore also means that the control program of the weaving loom is modified in such a way that the warp threads for each series of s warp thread systems are controlled as the warp threads of one combined warp thread system during weaving.

The warp threads of the configured weaving loom preferably also extend through the reed openings of a weaving reed, wherein the number of combined warp thread systems per meter (N) of the configured weaving loom equals the number of reed openings, or is a multiple of this number.

The warp threads of each combined warp thread system then run through the same opening of a weaving reed together for example.

The warp threads of each combined warp thread system may also be divided over two adjacent openings of the weaving reed, so that they are divided into two groups which are separated from one another by an intermediate reed dent. If, for example, s=2, the modification consists in combining two warp thread systems, which means that in each case two warp thread systems which are situated to the left and to the right of the same reed dent are combined.

The weaving loom is preferably configured in such a way that it is ready for the application of the above-described weaving method according to the present invention.

BRIEF DESCRIPTION OF THE DRAWINGS

In the following description, a preferred method for weaving a pile fabric according to the present invention is described in detail. The sole purpose thereof is to illustrate, and if necessary to clarify, what the particular features and advantages of this method and of the resultant pile fabrics are. This description can therefore by no means be seen as a limitation of the scope of protection of this patent.

In this description, reference is made to the attached FIGS. 1 and 2, each of which shows a diagrammatic cross section along the warp direction of a part of a pile fabric which is woven on a double-face weaving loom according to the present invention, the two figures showing the warp threads and the warp threads of a first and a second adjacent warp thread system, respectively.

DETAILED DESCRIPTION OF EMBODIMENTS

Figure 1:
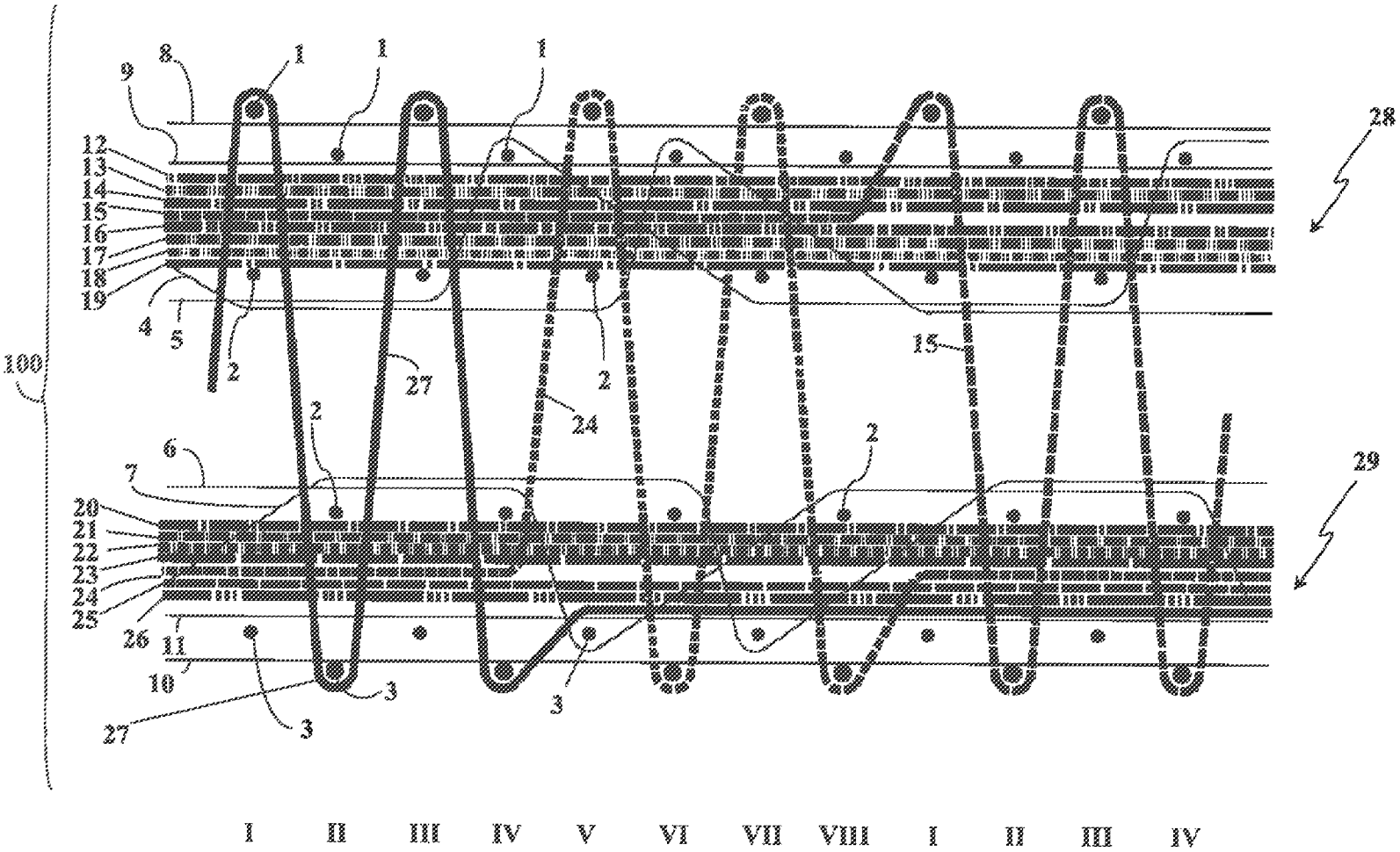

The double-face weaving loom is a triple-rapier weaving loom which is intended to insert three weft threads (1), (2), (3) in each insertion cycle (I-VIII) at respective insertion levels, one above the other, in a shed between warp threads (4-27). 500 warp thread systems per meter are provided (i.e. N=500), with each warp thread system containing the same warp threads. In the figures, the warp threads (4-27) of one such warp thread system are shown in each case. The figures also show the weft threads (1), (2), (3).

Each warp thread system (4-27) contains:

- two binding warp threads (5),(6) for forming an upper ground fabric (28),
- two binding warp threads (7),(8) for forming a lower ground fabric (29),
- two tension warp threads (8),(9) belonging to the upper fabric (28),
- two tension warp threads (10),(11) belonging to the lower fabric (29),
- eight pile warp threads (12-19) with mutually different colours which are intended for binding in the upper ground fabric (28) when they do not have to form pile, and eight pile warp threads (20-27) with mutually different colours which are intended for binding in the lower ground fabric (29) when they do not have to form pile, and wherein these colours also differ from the eight colours of the other pile warp threads (12-19) of the warp thread system which are intended to be bound in the upper ground fabric (28) when they do not have to form pile.

A jacquard machine cooperating with the weaving loom and/or a heddle frame drive cooperating with the weaving loom is provided to position the warp threads (4-27) according to a predetermined control program in each insertion cycle (I-VIII) in such a manner with respect to the three insertion levels that the fabric illustrated in the figure is produced.

The warp threads (4-27) of the different warp thread systems (of which 500 are provided per meter) extend through the openings of a weaving reed. By a number of the measures which are described below, a theoretical pile density of 1600 pile rows per meter is achieved in the warp direction. In this case, the above-defined imbalance factor is therefore 6.4 (3200/500). Pile warp threads with a yarn number of 8 Nm final are provided. Due to this imbalance, the pile legs are moved in the weft direction and a uniform pile distribution is achieved.

The warp threads of each warp thread system are divided into two groups which are situated in two adjacent reed openings, respectively. In this case, each group of eight pile warp threads contains two tension warp threads and two binding warp threads.

The left-hand group is situated in the right-hand part of the reed opening, while the right-hand group extends in the left-hand part of the reed opening which is adjacent on the right-hand side. Both groups are thus separated by an intermediate reed dent.

In each group, the two tension warp threads are provided to the left and right of the eight pile warp threads of this group, respectively, and they extend immediately next to these pile warp threads. As a result thereof, the pile warp threads are held in place well, thus supporting the formation of straight pile rows.

The two binding warp threads of each group are then placed to the left and right of the tension warp threads of this group, respectively, so that the binding warp threads run in pairs between two tension warp threads of adjacent groups.

If we consider the position of the warp threads of a warp thread system in the weaving reed (the so-called drawing-in) then we successively find, from left to right:

a binding warp thread, a tension warp thread, eight pile warp threads, a tension warp thread, a binding warp thread, the intermediate reed dent, a binding warp thread, a tension warp thread, eight pile warp threads, a tension warp thread and a binding warp thread.

In each insertion cycle (I-VIII), the binding warp threads (5),(6); (7),(8) and tension warp threads (9),(10); (11),(12) are positioned with respect to the three different insertion levels in such a manner that an upper (28) and a lower (29) ground fabric are woven one above the other, and that alternately, (i) the upper (1) and the middle (2) weft thread are inserted in the upper fabric, while the lower weft thread (3) is inserted in the lower fabric, and (ii) the upper weft thread (1) is inserted in the upper fabric, while the middle (2) and the lower (3) weft thread are inserted in the lower fabric, but, when two weft threads (1), (2) are inserted in the upper fabric, in each case a thicker weft thread is inserted for the upper weft thread (1), and the warp threads are positioned in such a manner that this thicker weft thread runs on the back of the upper fabric and is not bound in by the binding warp threads, and when two weft threads (2), (3) are bound in the lower fabric, in each case a thicker weft yarn is inserted for the lower weft thread (3), and the warp threads are positioned in such a manner that this thicker weft thread (3) runs on the back of the lower fabric and is not bound in by the binding warp threads.

The other weft threads (1-3) (i.e. not running on the back) are bound in each ground fabric (28),(29) by a pair of binding warp threads (5),(6); (7),(8).

In the upper fabric, one tension warp thread (8) is positioned in such a manner that it runs below the thicker weft thread (1) and runs above the other weft threads (2) of the fabric in each case. As a result thereof, the thicker weft threads (1) are reliably separated from the other weft threads (2) which are bound in the upper ground fabric (28) and these thicker weft threads (1) are reliably kept on the back of the ground fabric. Secondary binding warp threads may be provided in order to fix these weft threads (1) with respect to the ground fabric (28), but these are not shown in the figures. The other tension warp thread (9) is positioned in such a manner that it always runs between the upper (1) and the middle (2) weft thread, as a result of which the weft threads (1), (2) bound in the ground fabric (28) are divided over two different levels.

In the lower fabric, one tension warp thread (10) is positioned in such a manner that it runs above the thicker weft thread (3) and below the other weft threads (2) of the fabric in each case. As a result thereof, the thicker weft threads (3) are reliably separated from the other weft threads (2) which are bound in the lower ground fabric (29) and these thicker weft threads (3) are reliably kept on the back of the ground fabric (29). Secondary binding warp threads (not shown in the figures) can also fix these weft threads (3) with respect to the lower ground fabric (29). The other tension warp thread (9) of the lower fabric is positioned in such a way that it always runs between the middle weft thread (2) and the lower weft thread of the ground fabric (29), as a result of which these weft threads (2),(3) bound in the lower ground fabric are divided over two different levels.

For each pile point, one of the sixteen pile warp threads (12-27) is selected in accordance with a multi-coloured pattern to be woven in order to form pile by running alternately in the upper and the lower fabric over a weft thread (1), (3) which runs on the back. Thus, pile warp thread (27) forms pile over the weft threads (1), (3) which were inserted during the first (I), the second (II) and the third (III) insertion cycle which are shown furthest to the left in the figures.

The non-pile-forming pile warp threads (12-27) are bound in the ground fabrics and in this case are divided over the upper (28) and the lower (29) ground fabric. They run in the ground fabrics (28), (29) in an extended state, alternately above and below the weft threads (1,2), (2,3) which are bound in the ground fabrics.

Figure 2:
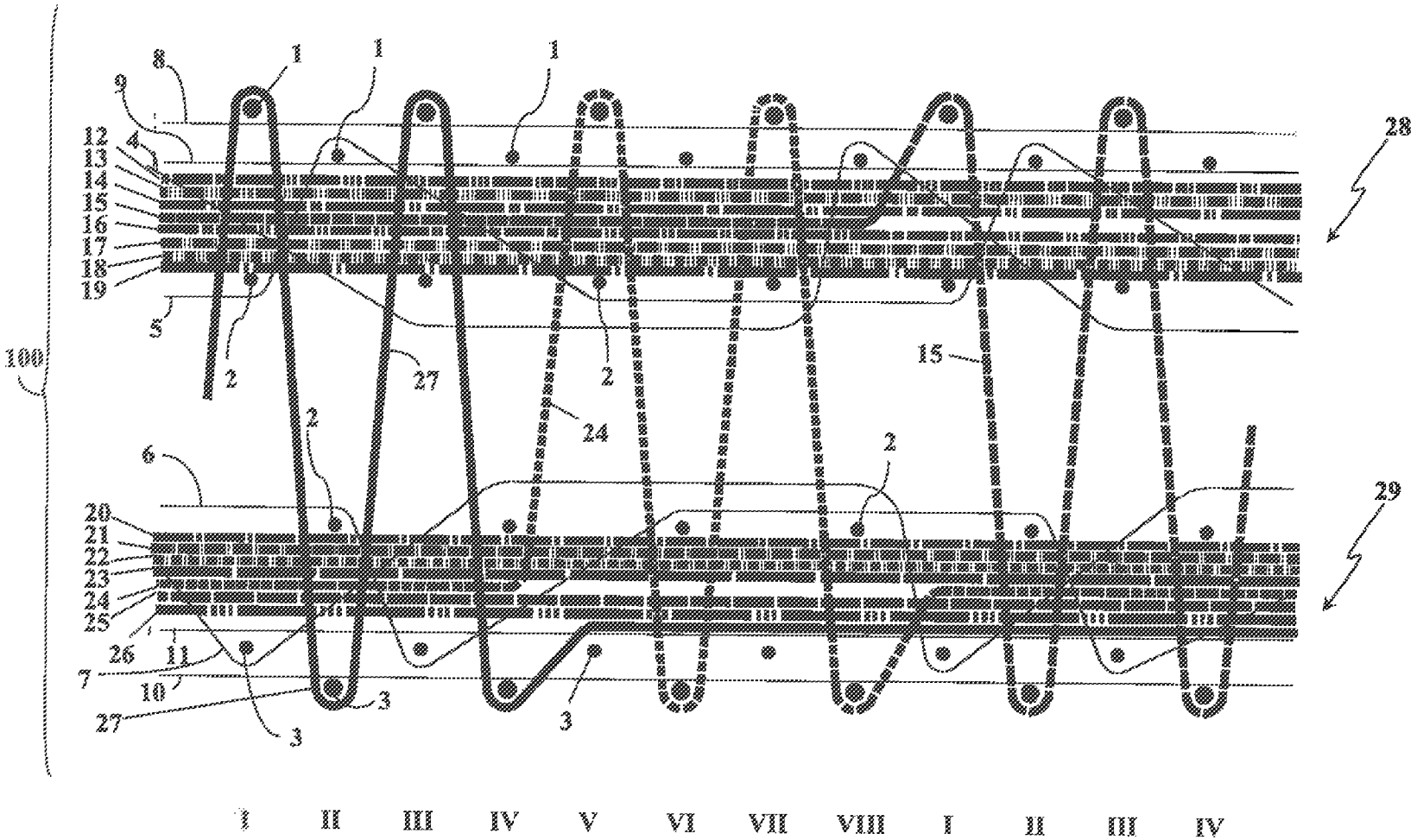

In adjacent warp thread systems, the binding warp threads (4),(5); (6), (7) have a different path, as can be seen in FIGS. 1 and 2. The two sets of binding warp threads of two adjacent warp thread systems cooperate in each ground fabric to bind in the respective weft threads (1,2), (2,3) in the openings which they form between their successive crossings. Considering each warp thread system separately, there are relatively few such crossings, which benefits the weft thread density, as explained above. This also contributes to an increase in the pile density in the warp direction.

The binding warp threads (5),(6); (7),(8) and the tension warp threads (8),(9); (10),(11) take up a sequence of positions with respect to the weft threads which have been inserted during the successive insertion cycles (I-VIII) and this sequence repeats for all these ground warp threads after eight insertion cycles (I-VIII), as can clearly be seen from the path of these warp threads shown in the figures.

The invention claimed is:

1. Weaving method, wherein, on a double-face weaving loom, in successive weft insertion cycles, in each case one or more weft threads are inserted at respective insertion levels between the warp threads of a number of warp thread systems, while the warp threads are positioned such that two ground fabrics can be woven one above the other from respective weft threads, binding warp threads and tension warp threads, wherein the respective weft threads are bound in openings between binding warp threads wherein a number of different pile-warp threads are provided for each warp thread system (100), at least one of which is alternately interlaced with the upper and the lower round fabric to form pile, and wherein the pile-forming pile warp threads between both ground fabrics are cut, so that two pile fabrics are produced, characterized in that between 200 and 1000 warp thread systems per meter are provided on the double-face weaving loom, in that, in each warp thread system, at least five different pile warp threads with a yarn number between 6 and 10 Nm final and at least two tension warp threads are provided per ground fabric, in that the tension warp threads are positioned in such a way that they divide the weft threads of each pile fabric over at least three different levels, while a ground weave repeat is used which runs over at least eight weft insertion cycles, and in that at least 16 pile rows per cm are formed in the warp direction.

2. Weaving method according to claim 1, characterized in that the weft threads bound in each ground fabric are divided over at least two different levels by at least one tension warp thread per warp thread system, while other weft threads run on the back of the ground fabrics without being bound in said openings between binding warp threads.

3. Weaving method according to claim 2, characterized in that the weft threads running on the back of the ground fabrics are separated from the other weft threads by a tension warp thread.

4. Weaving method according to claim 2, characterized in that the warp thread systems comprise secondary binding warp threads which are positioned in such a way that each pile fabric comprises a number of secondary binding warp threads which are alternately interlaced with the ground fabric, and run over at least one weft thread running on the back thereof in order to fix these weft threads with respect to the ground fabric.

5. Weaving method according to claim 2, characterized in that the pile-forming pile warp threads are in each case interlaced with the weft threads running on the back.

6. Weaving method according to claim 1, characterized in that the non-pile-forming pile warp threads are bound in the ground fabrics in an extended state.

7. Weaving method according to claim 1, characterized in that the weft threads are inserted between the warp threads provided on the weaving loom, wherein N warp thread systems per meter are provided, each with K different pile warp threads, and wherein K≥10 and N is an integer between 200 and 1000, preferably between 250 and 600, and most preferably equals 500.

8. Weaving method according to claim 1 characterized in that the weft threads for the ground fabric have a yarn number of between 6 and 16 Nm final, and in that any external weft threads which do not have to be bound in the ground fabric have a yarn number of between 4 and 8 Nm final.

9. Weaving method according to claim 1, characterized in that the warp threads on the weaving loom extend through the openings of a weaving reed, and in that the warp threads of each warp thread system are in this case divided over two adjacent openings of the weaving reed, so that they are divided into two groups which are separated from one another by an intermediate reed dent.

10. Weaving method according to claim 9, characterized in that a first group of warp threads of a first warp thread system and a second group of warp threads of a second warp thread system extend through each reed opening.

11. Weaving method according to claim 10, characterized in that the first and the second group are situated in a left-hand part and a right-hand part of the reed opening, respectively, in that at least one tension warp thread of the first group extends in the reed opening along the right-hand side of the pile warp threads of this group, and in that at least one tension warp thread of the second group extends in the reed opening along the left-hand side of the pile warp threads of this group.

12. Weaving method according to claim 9, characterized in that the warp threads extend through the openings of the weaving reed in such a way that N warp thread systems are in each case divided over N openings or N+1 openings of the weaving reed.

13. Weaving method according to claim 1, characterized in that, on a three-gripper weaving loom, in each case three weft threads are inserted at respective insertion levels between the warp threads in the successive weft insertion cycles.

14. Weaving method according to claim 1, characterized in that the double-face weaving loom is configured to weave two pile fabrics according to a weaving method wherein N warp thread systems per meter are provided, each with K different pile warp threads, and in that this configuration is achieved by modifying the configuration of a double-face weaving loom which is configured to weave using (a×N) warp thread systems per meter which each contain K/a different pile warp threads, this modification meaning that the (a×N) warp thread systems are divided into N series of a successive warp thread systems, and that, within each series, the K/a pile warp threads of (a−1) of these warp thread systems are replaced by K/a other pile warp threads, so that each series of a warp thread systems together contains K different pile warp threads and the warp threads (4-27) of each series together form one combined warp thread system, wherein K, K/a, N and a are integers, with a≥2, and wherein N is an integer between 200 and 1000.

15. Weaving method according to claim 14, characterized in that a=2.

16. Weaving method according to claim 14, characterized in that N=500, K=16 and a=2.

17. Weaving method according to claim 14, characterized in that the weaving loom is provided with positioning means which cooperate with a control device to position the warp threads in accordance with a predetermined control program, and in that the modification of the configuration of the weaving loom also means that the control program of the weaving loom is modified in such a way that the warp threads for each series of a warp thread systems are controlled as the warp threads of one combined warp thread system during weaving.

18. Weaving method according to claim 14, characterized in that the warp threads of the configured weaving loom extend through the reed openings of a weaving reed, and in that the number of combined warp thread systems per meter (N) of the configured weaving loom equals the number of reed openings, or is a multiple of this number.

19. Weaving method according to claim 14, characterized in that the warp threads of each combined warp thread system run through the same reed opening of a weaving reed together.

20. Weaving method according to claim 14, characterized in that the warp threads of each combined warp thread system are divided over two adjacent openings of the weaving reed, so that they are divided into two groups which are separated from one another by an intermediate reed dent.

21. Method for configuring a double-face weaving loom to weave two pile fabrics according to a weaving method, wherein, in successive weft insertion cycles, in each case one or more weft threads are inserted between warp threads provided on the weaving loom, wherein N warp thread systems per meter are provided, each with K different pile warp threads, wherein the warp threads are positioned in such a manner that two ground fabrics are woven, one above the other, from respective weft threads and binding warp threads, wherein at least one pile warp thread per warp thread system is alternately interlaced with the upper and the lower ground fabric to form pile, and wherein the pile-forming pile warp threads between both ground fabrics are cut, characterized in that the configuration of a double-face weaving loom which is intended for weaving with ($a \times N$) warp thread systems per meter which each contain K/a different pile warp threads, by dividing the ($a \times N$) warp thread systems into N series of a successive warp thread systems and by replacing, within each series, the K/a pile warp threads of ($a-1$) of these warp thread systems by K/a other pile warp threads, so that each series of a warp thread systems together contains K different pile warp threads, and the warp threads of each series together form one combined warp thread system, wherein K, K/a, N and a are integers and wherein $a \geq 2$.

22. Method for configuring a double-face weaving loom according to claim 21, characterized in that a=2.

23. Method for configuring a double-face weaving loom according to claim 21, characterized in that N=500, K=16 and a=2.

24. Method for configuring a double-face weaving loom according to claim 21, characterized in that the weaving loom is provided with positioning means which cooperate with a control device to position the warp threads in accordance with a predetermined control program, and in that configuring the weaving loom also means that the control program of the weaving loom is modified in such a way that the warp threads for each series of a warp thread systems are controlled as the warp threads of one combined warp thread system during weaving.

25. Method for preparing a double-face weaving loom according to claim 21, characterized in that the warp threads of the configured weaving loom extend through the reed openings of a weaving reed, and in that the number of combined warp thread systems per meter (N) of the configured weaving loom equals the number of reed openings, or is a multiple thereof.

26. Method for configuring a double-face weaving loom according to claim 21, characterized in that the warp threads of each combined warp thread system run through the same reed opening of a weaving reed together.

27. Method for configuring a double-face weaving loom according to claim 21, characterized in that the warp threads of each combined warp thread system are divided over two adjacent openings of the weaving reed, so that they are divided into two groups which are separated from one another by an intermediate reed dent.

* * * * *